US007694702B2

(12) United States Patent
Brown et al.

(10) Patent No.: US 7,694,702 B2
(45) Date of Patent: Apr. 13, 2010

(54) BEVERAGE MACHINE ASSEMBLY HAVING A MODULAR SUPPORT

(75) Inventors: Michael J. Brown, Baltimore, MD (US); Demetrios Stavrakis, Booklandville, MD (US)

(73) Assignee: Adcor Industries, Inc., Baltimore, MD (US)

( * ) Notice: Subject to any disclaimer, the term of this patent is extended or adjusted under 35 U.S.C. 154(b) by 917 days.

(21) Appl. No.: 11/501,337

(22) Filed: Aug. 9, 2006

(65) Prior Publication Data

US 2007/0034281 A1 Feb. 15, 2007

Related U.S. Application Data

(60) Provisional application No. 60/706,533, filed on Aug. 9, 2005.

(51) Int. Cl.
*B65B 43/42* (2006.01)
*B65B 1/00* (2006.01)

(52) U.S. Cl. ..... 141/148; 141/237; 141/275; 53/276

(58) Field of Classification Search ..... 141/2, 141/18, 144–148, 275, 234, 237; 53/276
See application file for complete search history.

(56) References Cited

U.S. PATENT DOCUMENTS

| | | | | |
|---|---|---|---|---|
| 3,310,834 | A | | 3/1967 | Simpson et al. |
| 3,760,561 | A | | 9/1973 | Over et al. |
| 3,888,615 | A | | 6/1975 | Ulmschneider et al. |
| 4,099,361 | A | | 7/1978 | Dix et al. |
| 4,109,446 | A | | 8/1978 | Krohn et al. |
| 4,186,161 | A | | 1/1980 | Ulmschneider et al. |
| 4,269,588 | A | | 5/1981 | Nogal |
| 4,370,124 | A | | 1/1983 | Buja |
| 4,549,865 | A | | 10/1985 | Myers |
| 4,650,412 | A | | 3/1987 | Windstrup et al. |
| 4,652,227 | A | | 3/1987 | Aoki |
| 4,726,757 | A | | 2/1988 | Berry |
| 4,938,261 | A | | 7/1990 | Petri et al. |
| 5,253,999 | A | | 10/1993 | Kosuge |
| 5,643,620 | A | | 7/1997 | Brun, Jr. |
| 5,645,870 | A | | 7/1997 | Larsen |
| 5,671,585 | A | | 9/1997 | Peronek et al. |
| 5,689,932 | A | * | 11/1997 | Peronek et al. ..... 53/201 |
| 5,732,528 | A | | 3/1998 | Peronek et al. |
| 5,778,633 | A | | 7/1998 | Sweeny |
| 5,884,677 | A | | 3/1999 | McKaughan |
| 6,179,605 | B1 | | 1/2001 | Littleton et al. |
| 6,662,526 | B2 | | 12/2003 | Riggs, Jr. et al. |
| 6,698,160 | B2 | | 3/2004 | Peronek et al. |
| 6,804,870 | B2 | | 10/2004 | Riggs, Jr. et al. |
| 6,834,478 | B2 | | 12/2004 | Peronek et al. |
| 6,898,920 | B2 | | 5/2005 | Höss |
| 6,973,761 | B2 | | 12/2005 | Peronek |
| 7,028,857 | B2 | | 4/2006 | Peronek |
| 2002/0017076 | A1 | | 2/2002 | Martin |

* cited by examiner

*Primary Examiner*—Timothy L Maust
(74) *Attorney, Agent, or Firm*—Howard & Howard Attorneys PLLC

(57) ABSTRACT

A filling machine assembly having supports for supporting any suitable fixture. At least one of the supports includes a plurality of modules with each of the modules including at least one coupling member for interlocking adjoining modules to form a continuous uninterrupted support. The modules can include sides with at least one coupling member mounted to each side. The coupling members are preferably complementary in configuration with each other for interlocking the first and second modules.

18 Claims, 4 Drawing Sheets

BEVERAGE MACHINE ASSEMBLY HAVING A MODULAR SUPPORT

CROSS REFERENCE TO RELATED APPLICATION

The subject patent application claims priority to and all the benefits of U.S. Provisional Patent Application No. 60/706,533, which was filed on Aug. 9, 2005.

BACKGROUND OF THE INVENTION

1. Field of the Invention

The subject invention relates to a filling machine assembly for filling a container with a fluid material.

2. Description of the Related Art

A filling machine assembly typically includes 40, 60, 72, 100, 120, or 130 fixtures, based on size, for supporting and filling containers with a fluid material, mounted on a support. There are numerous configurations of fixtures known in the art and may include filling valves and lift mechanisms. Filling valves are typically disposed on an upper support and aligned above a bottom support to which a like number of lift mechanisms are positioned. Each lift mechanism moves a container between a position engaging the filling valve for dispensing the fluid material into the container and a second position disengaged from the filling valve. Those skilled in the art will recognize that the support is often circular and is typically manufactured as a single cast piece, which creates a large, expense, and heavy component to the assembly.

A typical filling operation frequently requires changing the fixtures to accommodate different containers. Each fixture must be unclamped, removed and the correct fixture clamped before resuming the filling operation. As one can appreciate, the time and labor involved in unclamping and clamping the fixtures can be extensive, in addition to the cost of lost productivity. In addition to the risk of damage to the fixture during the clamping and unclamping process, each fixture must be individually calibrated once clamped to the support assembly.

One solution to frequent fixture changes involves the use of a quick change type fixture such as disclosed in U.S. Pat. No. 5,778,633 ('633). This quick change type fixture enables a fixture change by using interchangeable fixtures removably attached to a base assembly using a quick release fastener.

Maintenance and/or refurbishing of the filling machine assembly frequently requires removal of the support from the filling machine assembly at considerable cost in terms of time and labor due to the support assembly being a single piece. As one skilled in the art can appreciate, the solution disclosed in the '633 patent does not address the time and labor expense involved in removing the support from the filling machine assembly.

Accordingly, there is a need for an improved support design that reduces the current expense and time involved in removing the support during maintenance and/or refurbishing of the filling machine assembly.

SUMMARY OF THE INVENTION AND ADVANTAGES

The subject invention includes a beverage machine assembly having a plurality of fixtures. The beverage machine assembly can be a filling machine assembly for filling a plurality of containers with a fluid material. The filling machine assembly comprises a first support and a second support disposed below the first support. A plurality of filling valves are coupled to the first support for filling the containers with the fluid material. A plurality of lift mechanisms are coupled to the second support and aligned with a corresponding filling valve for moving the containers between a series of positions relative to the filling valves. The assembly is characterized by at least one of the first and second supports including a plurality of modules with each of the modules including at least one coupling member for interlocking adjoining modules to form a continuous uninterrupted support.

The modules can include a first module defining a first side and a second side and a second module defining a third side and a fourth side. The at least one coupling member can include a first coupling member mounted to the first and third sides of the first and second modules, respectively, and a second coupling member mounted to the second and fourth sides of the first and second modules, respectively. The second coupling members are complementary in configuration with the first coupling members for interlocking the first and second modules.

Accordingly, the subject invention provides an improved support that addresses the various problems found in the prior art, especially when servicing the filling machine assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
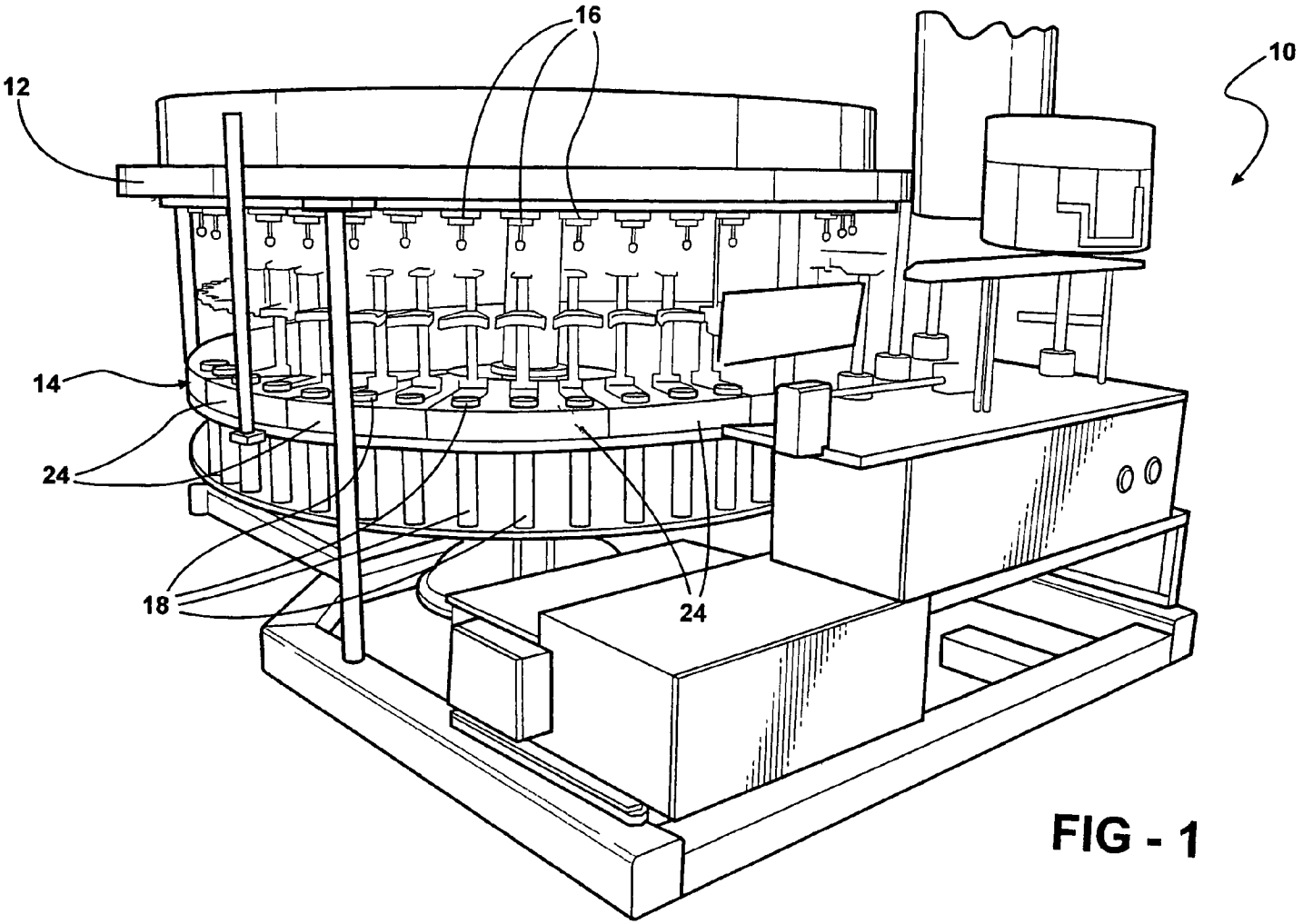
FIG. 1 is a perspective view of a filling machine assembly.
Figure 4:
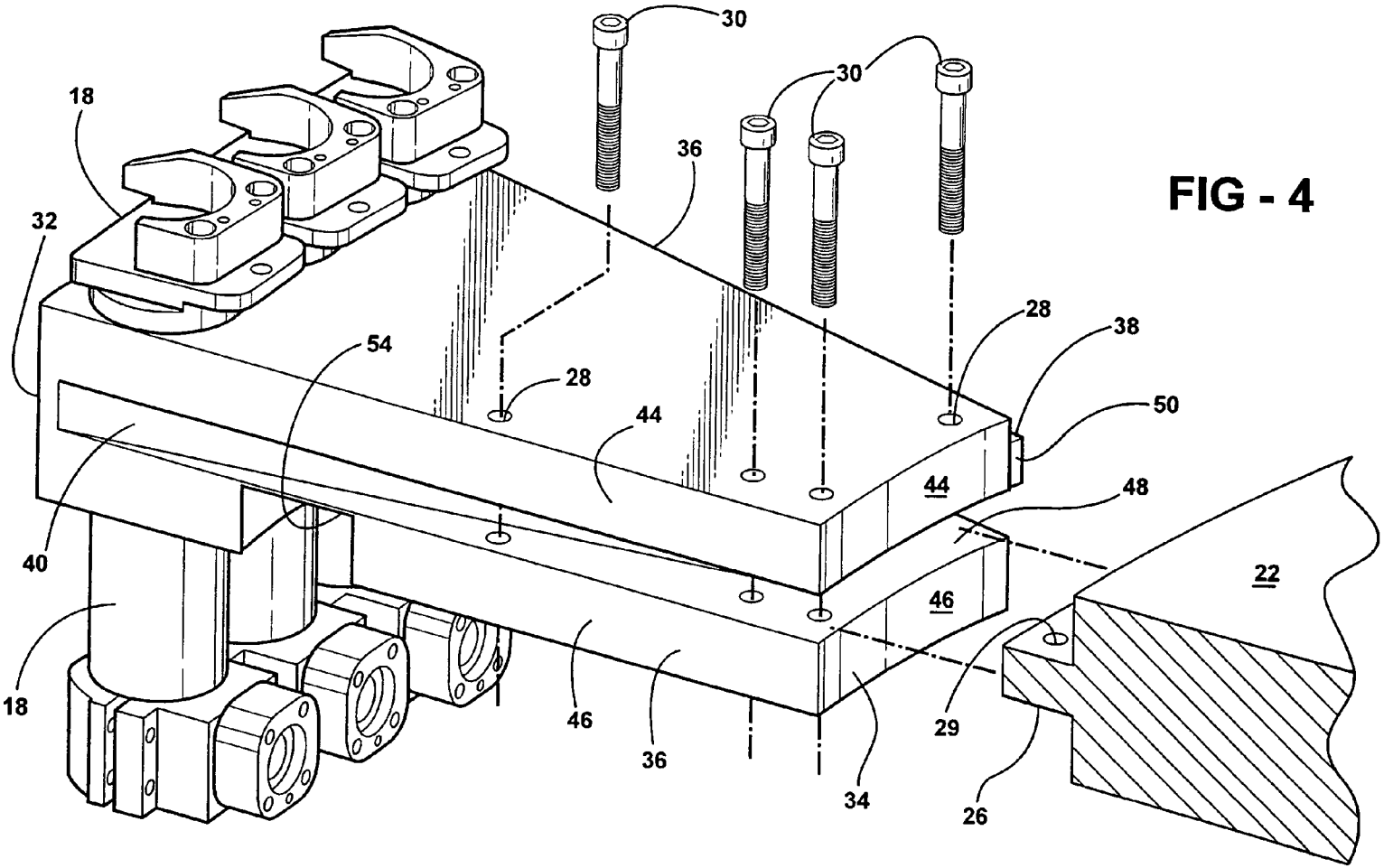
FIG. 4 is a perspective view of one of the modules including a sectional view of the central ring.

Referring to the Figures, wherein like numerals indicate like parts throughout the several views, a filling machine assembly for filling a container (not shown) with a fluid material is shown generally at 10 in FIG. 1. The filling machine assembly 10 includes a first support 12 and a second support 14. In the preferred embodiment, the second support 14 is disposed below the first support 12. A plurality of fixtures are disposed on the filling machine assembly 10 for filling the containers with the fluid material. In the embodiment illustrated, the fixtures include a plurality of filling valves 16 coupled to the first support 12 for filling a plurality of the containers with the fluid material. The fixtures also include a plurality of lift mechanisms 18 coupled to the second support 14. Each lift mechanism 18 aligns with a corresponding filling valve 16 for moving the containers between a series of positions relative to the filling valves 16. As illustrated in FIG. 1, the filling machine assembly 10 is a bottle filler for progressively filling bottles with a fluid material, such as water, juice, or a carbonated beverage. It should be appreciated that the supports 12, 14 may be in any suitable orientation relative to the assembly 10 and may be of any suitable size. In should also be appreciated that the fixtures may be of any suitable design or configuration for any type of beverage machine assembly. Further, the features of the subject invention, as discussed in greater detail below, may be used on any variety of bottle or can beverage machine assembly, filling machine assembly, or other like assembly. As a non-limiting example, the lift mechanisms 18 shown in FIG. 4 are for a can filler.

Figure 2:
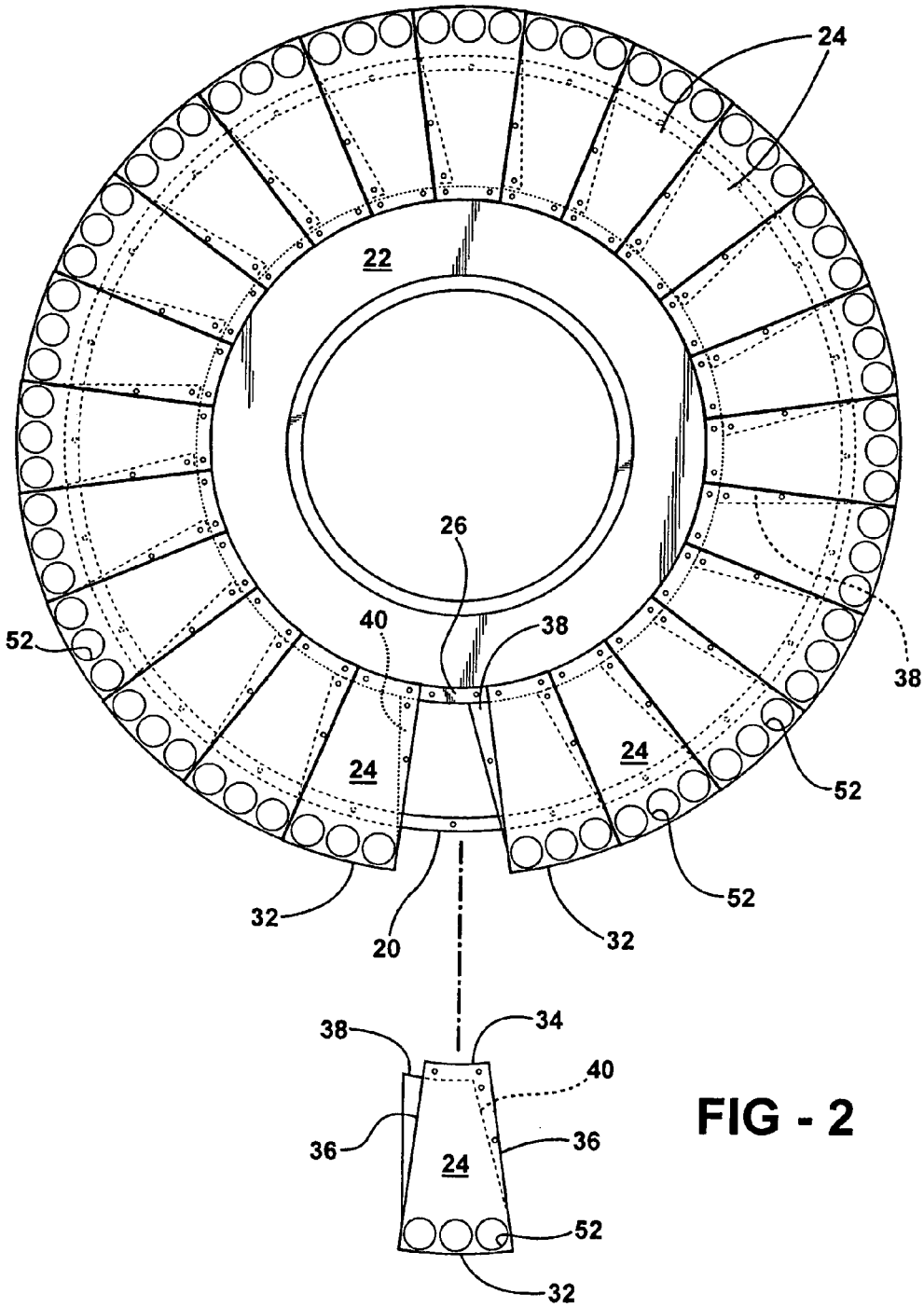
FIG. 2 is a plan view of a support including a plurality of modules disposed about a central ring in accordance with the subject invention.

Referring to FIGS. 1 and 2, at least one of the first 12 and second 14 supports includes a plurality of modules 24. There may be any suitable number of modules 24 depending upon the size and configuration of the filling machine assembly 10. Each of the modules 24 provide a partial support surface for a beverage machine assembly such as a filling machine assembly. The modules 24 support at least one, and preferably more than one, of the fixtures. In particular, each of the modules 24 further define at least one, and preferably more than one, mounting cavity 52 for receiving and supporting at least one of the lift mechanisms 18 and the filling valves 16. As discussed in greater detail below, the plurality of modules 24 are interconnected to define a continuous uninterrupted support, which is illustrated as the second support 14 for supporting a number of lift mechanisms 18. As appreciated and as discussed above, the subject invention is not limited to a support for supporting lift mechanisms and the modules 24 can be used to create any suitable support in any suitable filling machine assembly or like assembly.

As shown in FIG. 2, the filling machine assembly includes an outer mounting ring 20 and a central ring 22 for mounting and supporting the modules 24. Preferably, the modules 24 extend radially from the central ring 22 to define an annular configuration for the continuous uninterrupted second support 14 when the modules 24 are interlocked.

Turning to FIGS. 2-5, the modules 24 will now be discussed in greater detail. Each of the modules 24 further includes an outer face 32 and an inner face 34 spaced apart and interconnected by opposing sides 36. The mounting cavities 52 are preferably disposed adjacent the outer face 32. The inner face 34 is narrower than the outer face 32 to define a wedge-shaped configuration for each of the modules 24. The plurality of wedged-shaped modules 24 form the annular support 14. Preferably, the inner face 34 and the outer face 32 have an arcuate configurations.

As best shown in FIG. 4, the inner face 34 defines a mounting slot 48 for mounting each of the modules 24 to the central ring 22. In particular, the inner face 34 of each of the modules 24 includes an upper lip 44 and a lower lip 46 defining the mounting slot 48. The central ring 22 preferably includes a lip 26 disposed about a circumference of the central ring 22. The mounting slot 48 engages the lip 26 for mounting each of the modules 24. A plurality of fasteners 30 are provided (only one is illustrated in FIG. 4) for securing each of the modules 24 to an adjacent module 24 and to the central ring 22. Each of the modules 24 define a plurality of fastening holes 28 for receiving the fasteners 30. Also, the central ring 22 preferably includes at least one aperture 29 for receiving the fasteners 30.

At least a portion of the central ring 22 defines a substantially horizontal plane with the modules 24 mounted to the central ring 22 and angled relative to the horizontal plane for directing the fluid material away from the modules 24. Preferably, the inner face 34 is mounted to the central ring 22 and each module 24 angles downwardly from the outer face 32 to the inner face 34 relative to the horizontal plane for directing the fluid material from the module 24 toward the central ring 22. It is contemplated that for large filling machine assemblies, those having more than one hundred filling valves, for example, the modules 24 are angled relative to the horizontal plane for directing the fluid material away from the modules 24. It is further contemplated that for smaller filling machine assemblies, those having fewer than one hundred filling valves, for example, that both the module 24 and the central ring 22 may be angled relative to the horizontal plane for directing the fluid material away from the modules 24 and the ring 22. It should be appreciated that the angle of the modules 24 will be slight but adequate enough to prevent pooling of fluid material on the modules 24. As mentioned above, depending upon the size and configuration of the filling machine assembly, the central ring 22 may also have a taper or chamfer for directing fluid material away from the central ring 22.

Referring back to FIGS. 2-5, each of the modules 24 includes at least one coupling member 38, 40 for interlocking adjoining modules 24 to form the continuous uninterrupted second support 14. The at least one coupling member 38, 40 is further defined as a first coupling member 38 and a second coupling member 40. The first coupling member 38 is disposed on one side 36 of the module 24 and the second coupling member 40 is disposed on an opposing side 36 of the module 24. The coupling members 38, 40 are designed to interlock with a portion of the beverage machine assembly for supporting a fixture on the beverage machine assembly. Preferably, the coupling members 38, 40 are designed to interlock with other coupling members 38, 40 on an adjacent module 24.

As shown in FIG. 2, the plurality of modules 24 can include a first module 24 defining particular sides 36, such as a first side and a second side. Also, the plurality of modules 24 can includes a second module 24 defining particular sides 36, such as a third side and a fourth side. The first coupling member 38 can be mounted to the first and third sides of the first and second modules 24, respectively, and the second coupling member 40 can be mounted to the second and fourth sides of the first and second modules 24, respectively. The second coupling members 40 are complementary in configuration with the first coupling members 38 for interlocking the plurality of modules 24, such as the first and second modules 24. The first coupling member 38 and the second coupling member 40 are preferably integrally formed with each module 24. The wedge shape of each of the modules 24 in conjunction with the design of the coupling members 38, 40 enable rapid cost effective fixture change by permitting individual modules 24 to be removed from a support, such as the second support 14, and replaced by another of the modules 24 having a calibrated fixture already installed.

In the most preferred embodiment, the first coupling member 38 is further defined as a tab 38. The tab 38 is integrally formed on one side 36 of the module 24. The design of the tab 38 is further defined as a wedge-shaped wall extending along the side 36. The wedge-shaped wall includes a tip 42 disposed adjacent the outer face 32 extending simultaneously outward from the module 24 and toward the inner face 34 to a base 50. The base 50 of the wedge-shaped wall is arcuate and contiguous with the mounting slot 48.

Also, in the most preferred embodiment, the second coupling member 40 is further defined as a recess 40 for engaging the tab 38 of an adjacent module 24 when the modules 24 are interlocked. The recess 40 is integrally formed on an opposing side 36 of the modules 24 from the tab 38. The recess 40 extends from the outer face 32 toward the inner face 34 and is defined by the upper lip 44 and the lower lip 46 and is of similar dimensions as the tab 38. In other words, the tab 38 and the recess 40 are complimentary in configuration with each other. As illustrated, each of the plurality of modules 24 are substantially identical to each other. It should be appreciated that the modules 24 can include any suitable design or configuration for the first 38 and second 40 coupling members. Further, although the coupling members 38, 40 are preferably complimentary with each other, the modules 24 do not necessarily need to be identical to each other.

Figure 3:
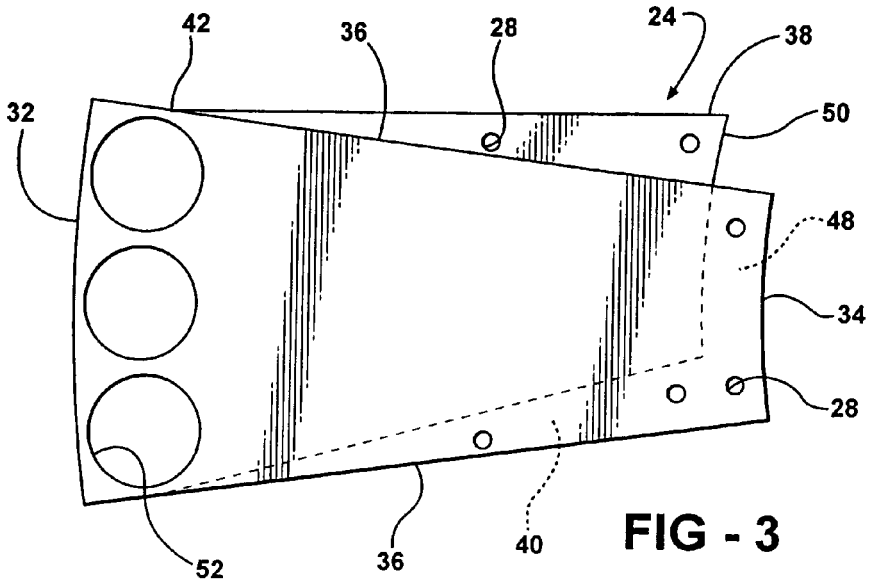
FIG. 3 is a top plan view of one of the modules.
Figure 5:
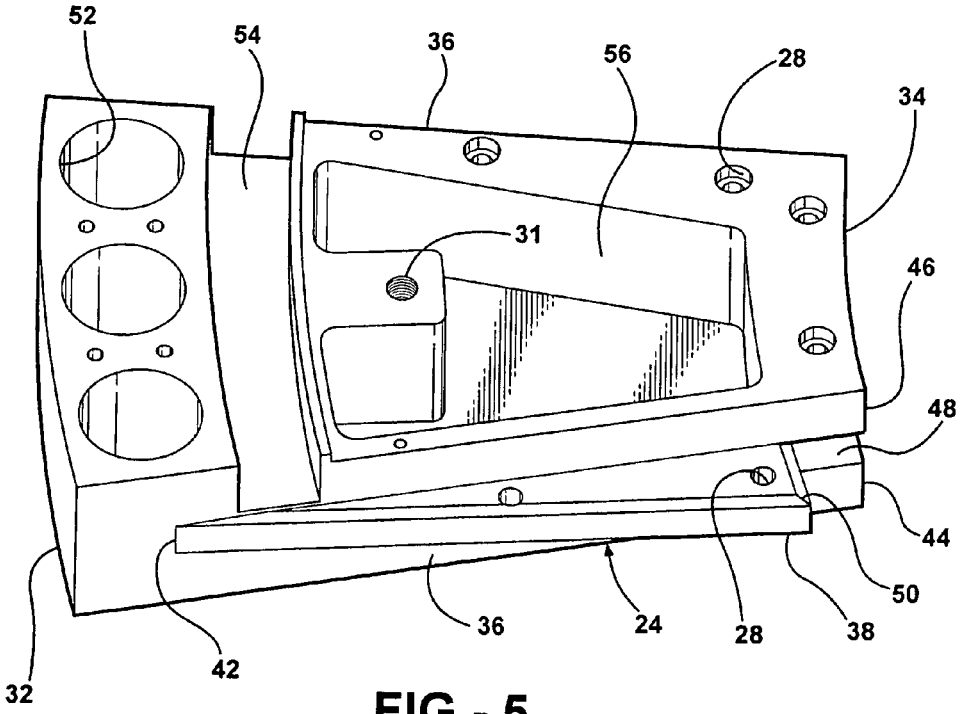
FIG. 5 is a perspective bottom view of one of the modules.

Each of the modules 24 interlock with adjoining modules 24 by the tab 38 engaging the recess 40 of a first adjoining module 24 and the recess 40 receiving the tab 38 of a second adjoining module 24 to form the continuous uninterrupted support having the annular configuration. The fastening holes 28 of the module 24 receive the fasteners 30 to secure each of the modules 24 to the lip 26 and adjoining modules 24. As best shown in FIGS. 4 and 5, at least one of the fastening holes 28, and preferably a pair of the fastening holes 28, is defined in a direction transverse to the recess 40. As best shown in FIGS. 3 and 5, the tab 38 includes at least one, and preferably more than one, of the fastening holes 28. As such, when the modules 24 are interlocked, at least one of the fasteners 30 passes through the fastening hole 28 in the upper lip 44, through the fastening hole 28 in the tab 38 of an adjacent module 24, and into the fastening hole 28 in the lower lip 46. Also, when the modules 24 are interlocked, at least one of the fasteners 30 passes through the fastening hole 28 in the upper lip 44, through the aperture 29 in the lip 26 of the central ring 22, and into the fastening hole 28 in the lower lip 46.

Referring to FIG. 5, the module 24 further defines a channel 54, which may be arcuate, extending between opposing sides 36. As known to those skilled in the art, the channel 54 is designed to receive a ring gear (not shown) for facilitating rotation of the support. The module 24 can have an irregular recess 56 defining a mounting block having a hole 31. One of the fasteners 30 passes through the outer mounting ring 20 and into the hole 31 for further securing each of the modules 24 to the assembly 10.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. A filling machine assembly for filling a plurality of containers with a fluid material, said machine comprising;

a first support, a plurality of filling valves coupled to said first support for filling the containers with the fluid material, a second support disposed below said first support, a plurality of lift mechanisms coupled to said second support and aligned with a corresponding filling valve for moving the containers between a series of positions relative to said filling valves, and at least one of said first and second supports including a plurality of modules with each of said modules including at least one coupling member for interlocking adjoining modules to form a continuous uninterrupted support.

2. An assembly as set forth in claim 1 wherein said at least one coupling member is further defined as a first coupling member and a second coupling member.

3. An assembly as set forth in claim 2 wherein each of said modules includes opposing sides with said first coupling member disposed on one side and said second coupling member disposed on an opposing side.

4. An assembly as set forth in claim 3 wherein said first coupling member is further defined as a tab and said second coupling member is further defined as a recess for engaging said tab of an adjacent module when said modules are interlocked.

5. An assembly as set forth in claim 1 wherein each of said plurality of modules are substantially identical to each other.

6. An assembly as set forth in claim 1 wherein said continuous uninterrupted support is further defined as having an annular configuration when said modules are interlocked.

7. An assembly as set forth in claim 1 wherein each of said modules further include an outer face and an inner face spaced apart and interconnected by opposing sides.

8. An assembly as set forth in claim 7 wherein said inner face is narrower than said outer face to define a wedge shaped configuration for said module.

9. An assembly as set forth in claim 8 wherein said inner face has an arcuate configuration.

10. An assembly as set forth in claim 7 wherein each of said modules further define at least one mounting cavity adjacent said outer face for supporting at least one of said lift mechanisms and said filling valves.

11. An assembly as set forth in claim 7 further including a central ring for mounting said modules.

12. An assembly as set forth in claim 11 wherein said inner face defines a mounting slot for mounting said module to said central ring.

13. An assembly as set forth in claim 11 further including a plurality of fasteners for securing each of said modules to an adjacent module and to said central ring.

14. An assembly as set forth in claim 13 wherein each of said modules define a plurality of fastening holes for receiving said fasteners.

15. An assembly as set forth in claim 14 wherein at least one of said fastening holes is defined in a direction transverse to said recess.

16. An assembly as set forth in claim 15 wherein said tab includes at least one of said fastening holes.

17. An assembly as set forth in claim 1 further including a central ring with at least a portion of said central ring defining a substantially horizontal plane with said modules mounted to said ring and angled relative to said horizontal plane for directing said fluid material away from said modules.

18. An assembly as set forth in claim 17 wherein each of said modules includes an outer face and an inner face with said inner face mounted to said central ring and said module angled downwardly from said outer face to said inner face relative to said horizontal plane for directing said fluid material from said module toward said ring.

* * * * *